US012696987B2

(12) United States Patent
Siazon et al.

(10) Patent No.: US 12,696,987 B2
(45) Date of Patent: Aug. 4, 2026

(54) MERCHANDISE SECURITY SYSTEM

(71) Applicant: Fasteners for Retail, Inc., Twinsburg, OH (US)

(72) Inventors: Sonny Siazon, Woodstock, IL (US); Shane Obitts, North Ridgeville, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 18/908,381

(22) Filed: Oct. 7, 2024

(65) Prior Publication Data

US 2025/0113927 A1 Apr. 10, 2025

Related U.S. Application Data

(60) Provisional application No. 63/588,877, filed on Oct. 9, 2023.

(51) Int. Cl.
*A47F 3/00* (2006.01)
*A47F 1/12* (2006.01)

(52) U.S. Cl.
CPC ..... *A47F 3/002* (2013.01); *A47F 1/126* (2013.01)

(58) Field of Classification Search
CPC .. A47F 3/002; A47F 1/126; A47F 1/12; A47F 1/125; A47F 1/128
See application file for complete search history.

(56) References Cited

U.S. PATENT DOCUMENTS 1,718,249 A * 6/1929 Morin ..... A47F 3/002 109/51
4,130,326 A * 12/1978 Hornblad ..... A47F 3/002 312/42
4,682,825 A * 7/1987 Crosslen ..... A47F 3/002 221/303
5,408,775 A * 4/1995 Abramson ..... G09F 3/18 40/655
6,434,871 B2 * 8/2002 Conway ..... G09F 3/204 40/642.02
7,150,365 B2 * 12/2006 Hardy ..... A47F 3/002 211/189
8,152,006 B2 * 4/2012 Wamsley ..... A47F 5/005 211/119.003
8,622,227 B2 * 1/2014 Bird ..... A47F 3/002 211/119.003

(Continued)

FOREIGN PATENT DOCUMENTS

DE 10259397 A1 * 7/2004 ..... A47F 3/002
DE 102012101421 A1 * 8/2013 ..... A47F 1/12
EP 1692977 A1 * 8/2006 ..... A47F 3/002

*Primary Examiner* — Stanton L Krycinski
(74) *Attorney, Agent, or Firm* — Honigman LLP; Andrew J. Boes

(57) ABSTRACT

A merchandise display system comprises a tile rail defining a tile track extending along a first direction, and a plurality of tiles slidably engaged with the tile rail and configured to independently translate along the first direction, each tile of the plurality of tiles including a pair of bearing rails engaged with the tile track, and each tile including a tile carriage slidably engaged with the tile rail and a front tile panel extending away transverse to the tile carriage, the front tile panel including an aperture formed therethrough.

10 Claims, 16 Drawing Sheets

(56) References Cited

U.S. PATENT DOCUMENTS

| | | | | |
|---|---|---|---|---|
| 8,646,623 | B2 * | 2/2014 | Winig | A47F 7/0243 70/57.1 |
| 8,973,765 | B2 * | 3/2015 | Wamsley | A47F 1/04 211/119.003 |
| D937,611 | S * | 12/2021 | Fink | D6/672 |
| 11,357,341 | B2 * | 6/2022 | Ewing | A47F 3/002 |
| 11,540,628 | B2 * | 1/2023 | Brück | G08B 13/1436 |
| 11,647,849 | B2 * | 5/2023 | Horvath | A47F 10/02 49/14 |
| 11,941,957 | B2 * | 3/2024 | Marszalek | G07C 9/00944 |
| 12,059,084 | B2 * | 8/2024 | Hua | A47F 1/12 |
| 2001/0026115 | A1 * | 10/2001 | Hakemann | A47F 3/12 312/328 |
| 2011/0220597 | A1 * | 9/2011 | Sherretts | A47F 1/128 211/59.3 |
| 2023/0172372 | A1 * | 6/2023 | Hua | A47B 57/585 211/59.4 |
| 2023/0309714 | A1 * | 10/2023 | Gulick, Jr. | A47F 3/002 |

* cited by examiner

MERCHANDISE SECURITY SYSTEM

CROSS REFERENCE TO RELATED APPLICATIONS

This U.S. patent application claims priority under 35 U.S.C. § 119(e) to U.S. Provisional Application 63/588,877, filed on Oct. 9, 2023. The disclosure of this prior application is considered part of the disclosure of this application and is hereby incorporated by reference in their entireties.

FIELD

The present disclosure relates generally to merchandise security systems.

BACKGROUND

This section provides background information related to the present disclosure and is not necessarily prior art.

In self-service retail establishments, such as drug stores, grocery stores and the like, articles are usually displayed for sale on racks consisting of vertically spaced shelves on which the articles are arranged in rows. Although merchandise in such retail environments is accessible substantially only from the front, the shelves previously employed have permitted unobstructed access to the space at the front of and above the merchandise supported on each shelf. In this way, a person could very quickly and easily remove a large number of articles at one time. It is known for individuals to "sweep" a shelf with their arm, collecting the items into a purse, bag or coat very quickly. Thus, a person could remove a significant amount of merchandise with very little effort and without great risk of being detected. Similar theft problems exist for merchandise displayed on hooks mounted on pegboards or the like.

SUMMARY

One aspect of the disclosure provides a merchandise display system for a retail shelf. The system includes a tile rail defining a tile track extending along a first direction, and a plurality of tiles slidably engaged with the tile rail and configured to independently translate along the first direction. Each tile of the plurality of tiles includes a pair of bearing rails engaged with the tile track.

Implementations of the disclosure may include one or more of the following optional features. In some examples, each tile includes a tile carriage slidably engaged with the tile rail and a front tile panel extending transverse to the tile carriage, the front tile panel including an aperture formed therethrough.

In some implementations, a width of the front tile panel extends from a first side surface to an opposite second side surface, at least one of the side surfaces defining an indentation.

In some configurations, the indentation is aligned with the aperture along the width of the front tile panel.

In some further implementations, the indentation and the aperture are disposed adjacent to the tile carriage. In some other further implementations, a distance from the aperture to the indentation ranges from 50 mm to 100 mm, and the indentation includes a plurality of ribs. In some other examples, each of the bearing rails defines a width ranging from 10 mm to 75 mm.

The system may include an audible feedback system configured to generate an audible feedback output when the tile is translated along the rail. In some examples, the audible feedback system includes an audible feedback emitter attached to the tile, the audible feedback emitter including an emitter device sensor configured to generate motion sensor data when the tile is translated and a speaker configured to generate the audible feedback output when the motion sensor data is generated.

Another aspect of the disclosure provides a merchandise display system for a retail shelf. The system includes a tile rail defining a tile track extending along a first direction, and a plurality of tiles slidably engaged with the tile rail and configured to independently translate along the first direction. Each tile includes a tile carriage slidably engaged with the tile rail and a front tile panel extending away transverse to the tile carriage, the front tile panel including an aperture formed therethrough.

Implementations of this aspect of the disclosure may include one or more of the following optional features. In some examples, the system includes each tile of the plurality of tiles including a pair of T-shaped bearing rails engaged with the tile track.

In some examples, each of the bearing rails defines a width ranging from 10 mm to 75 mm. In some implementations, a width of the front tile panel extends from a first side surface to an opposite second side surface, at least one of the side surfaces defining an indentation. In some further implementations, the indentation is aligned with the aperture along the width of the front tile panel.

In some even further implementations, the indentation and the aperture are disposed adjacent to the tile carriage. In some other even further implementations, a distance from the aperture to the indentation ranges from 50 mm to 100 mm. In some other additional even further implementations, the indentation includes a plurality of ribs.

In some other examples, the system includes an audible feedback system configured to generate an audible feedback output when the tile is translated along the rail.

In some other further examples, the audible feedback system includes an audible feedback emitter attached to the tile, the audible feedback emitter including an emitter device sensor configured to generate motion sensor data when the tile is translated and a speaker configured to generate the audible feedback output when the motion sensor data is generated.

DRAWINGS

The drawings described herein are for illustrative purposes only of selected configurations and not all possible implementations, and are not intended to limit the scope of the present disclosure.

Figure 14:
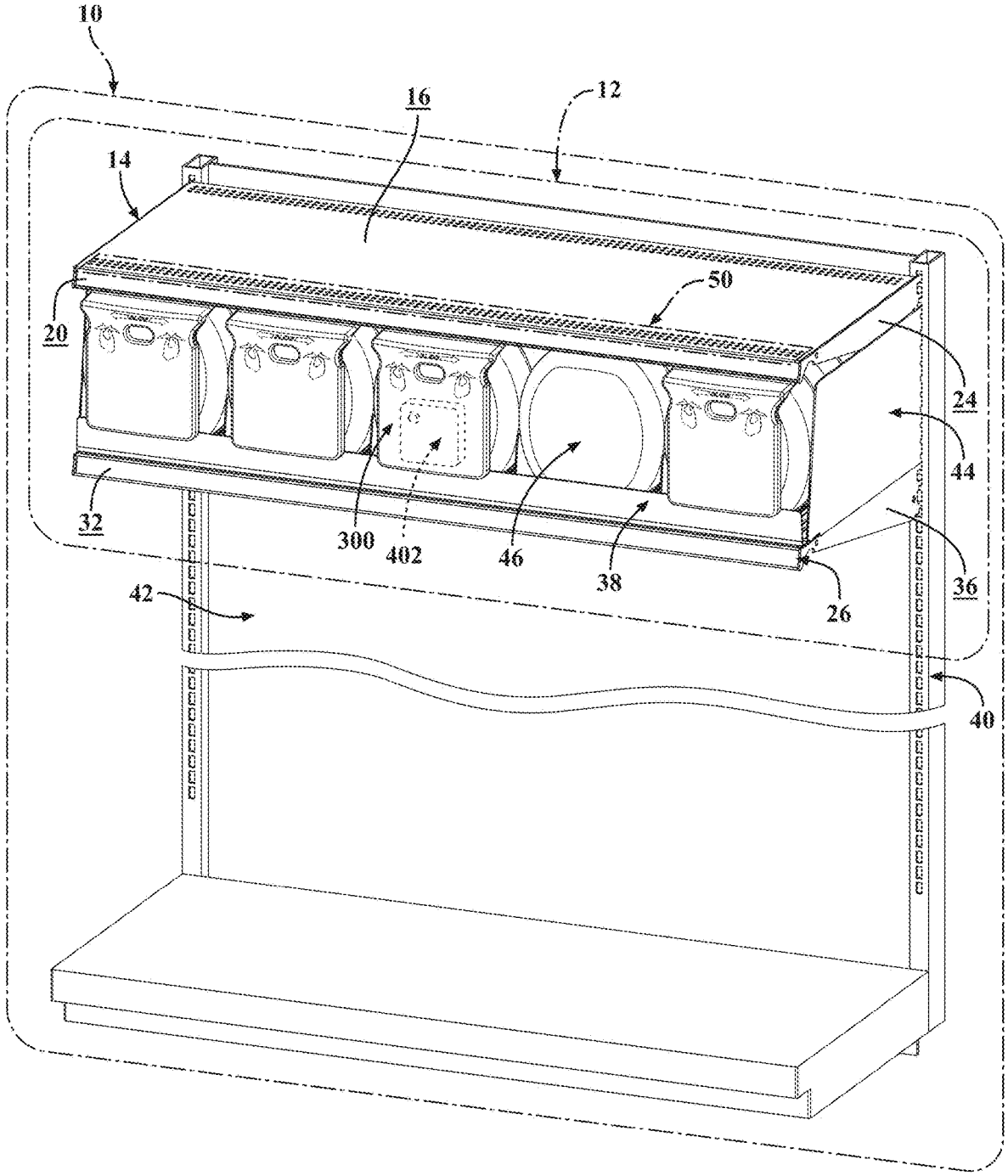
FIG. 14 is the perspective view of another example of a merchandise display unit according to the principles of the present disclosure, where an emitter device is incorporated into a tile of the merchandise display unit.
Figure 15:
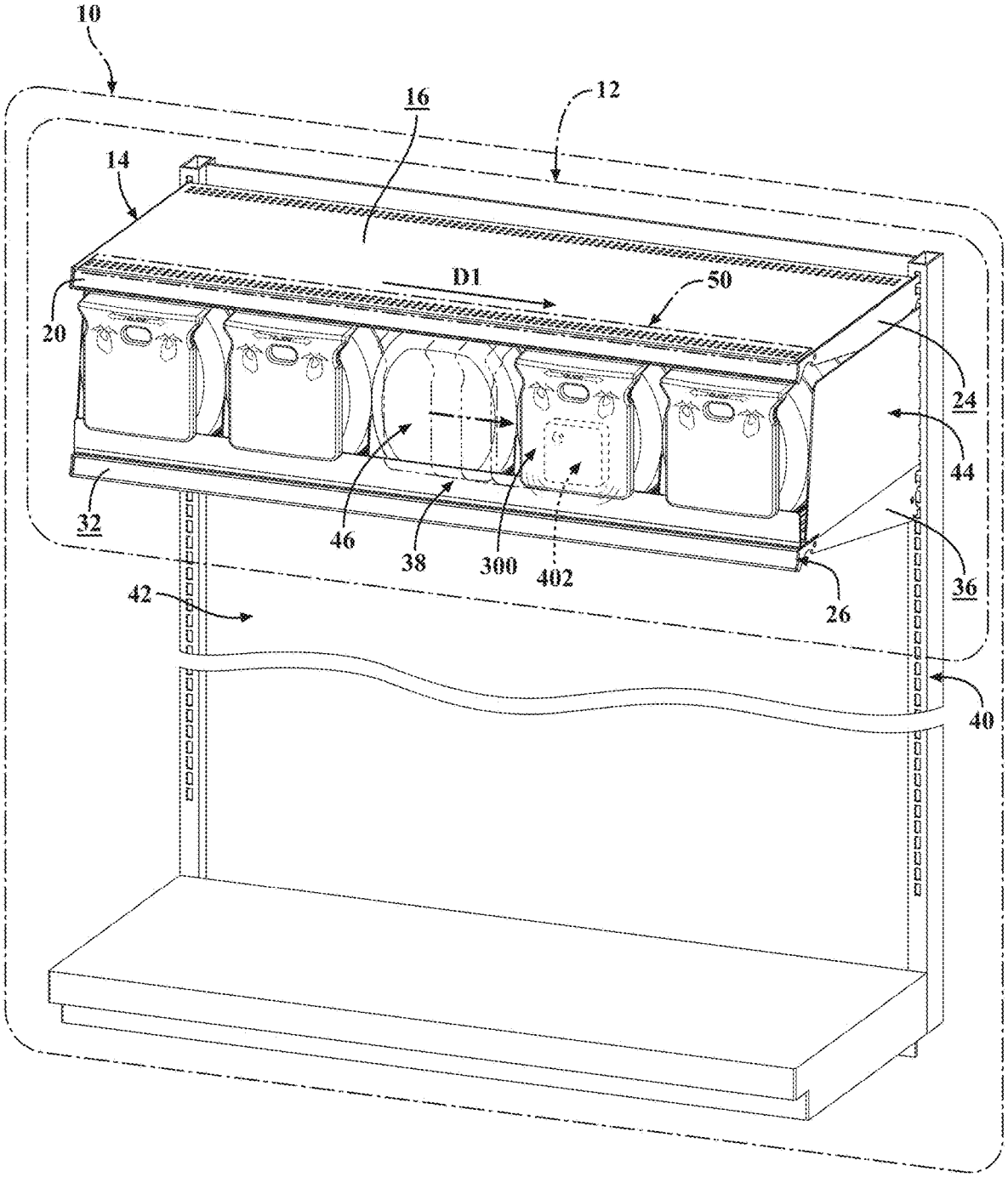
FIG. 15 is the perspective view of the merchandise shelving unit of FIG. 14, with one of the tiles moved to a second position from its first position seen in FIG. 14.
Figure 16:
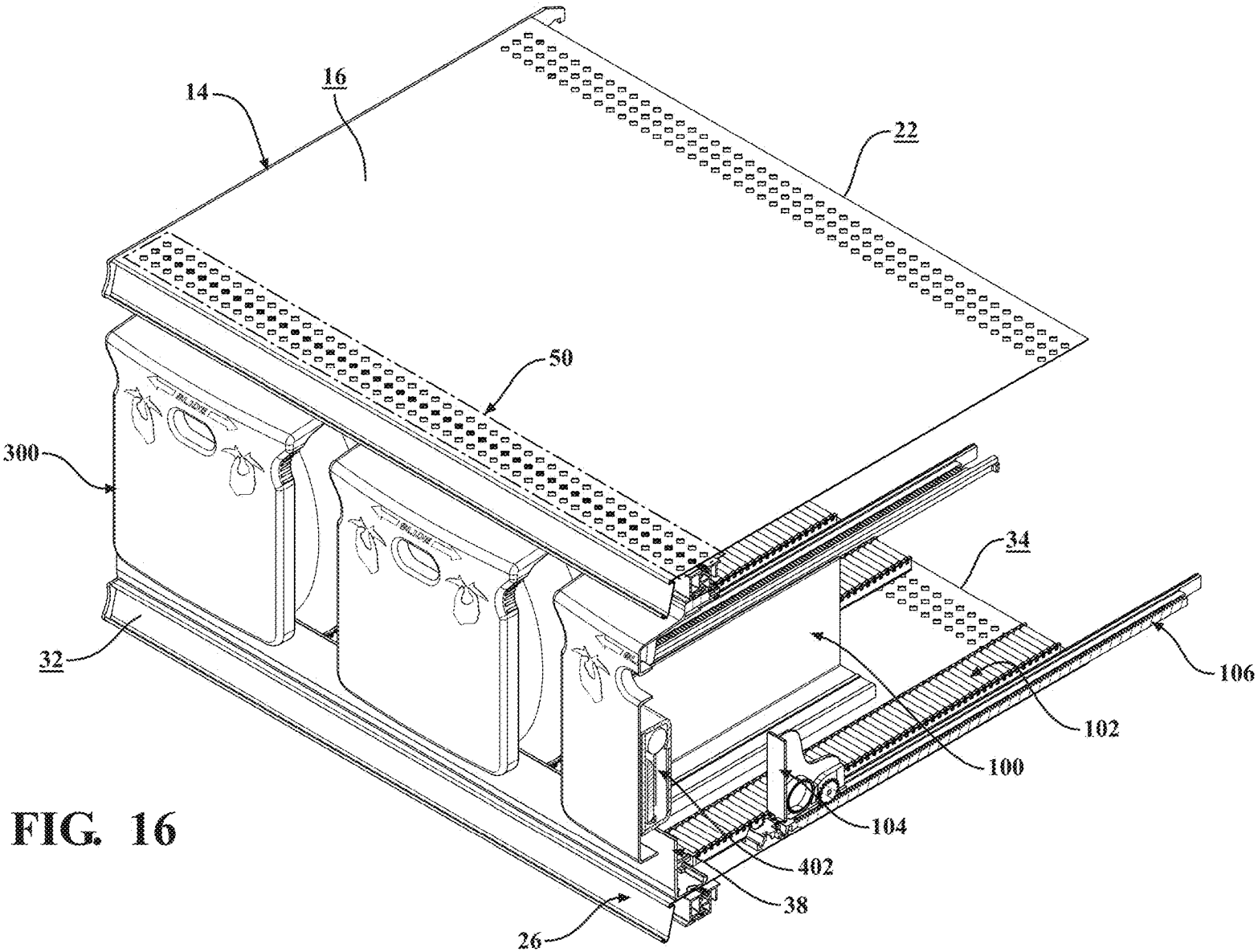
FIG. 16 is a cross-sectional view of the merchandise shelving unit of FIG. 14, taken along Line 16-16 of FIG. 14.
Figure 17:
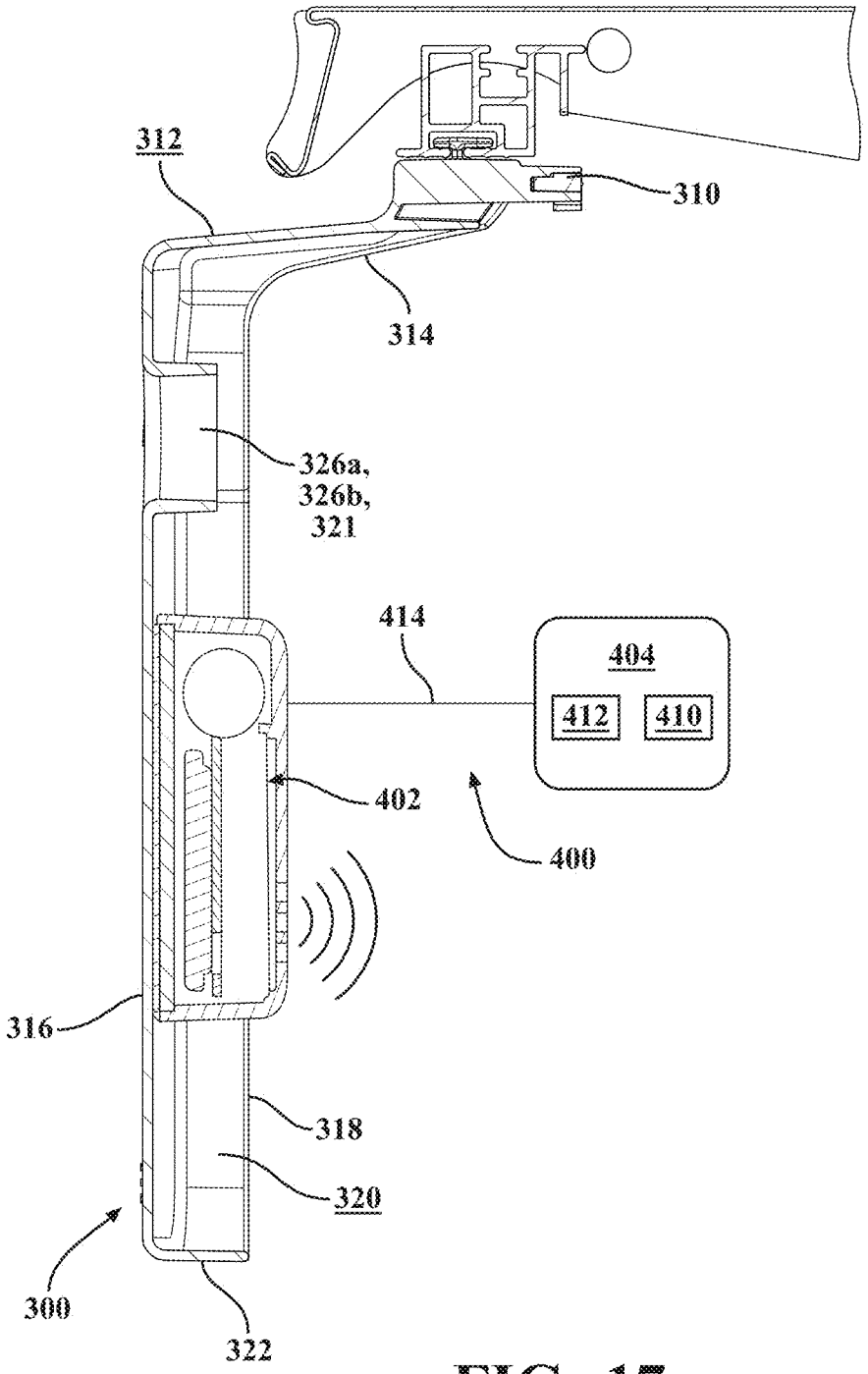
Figure 18:
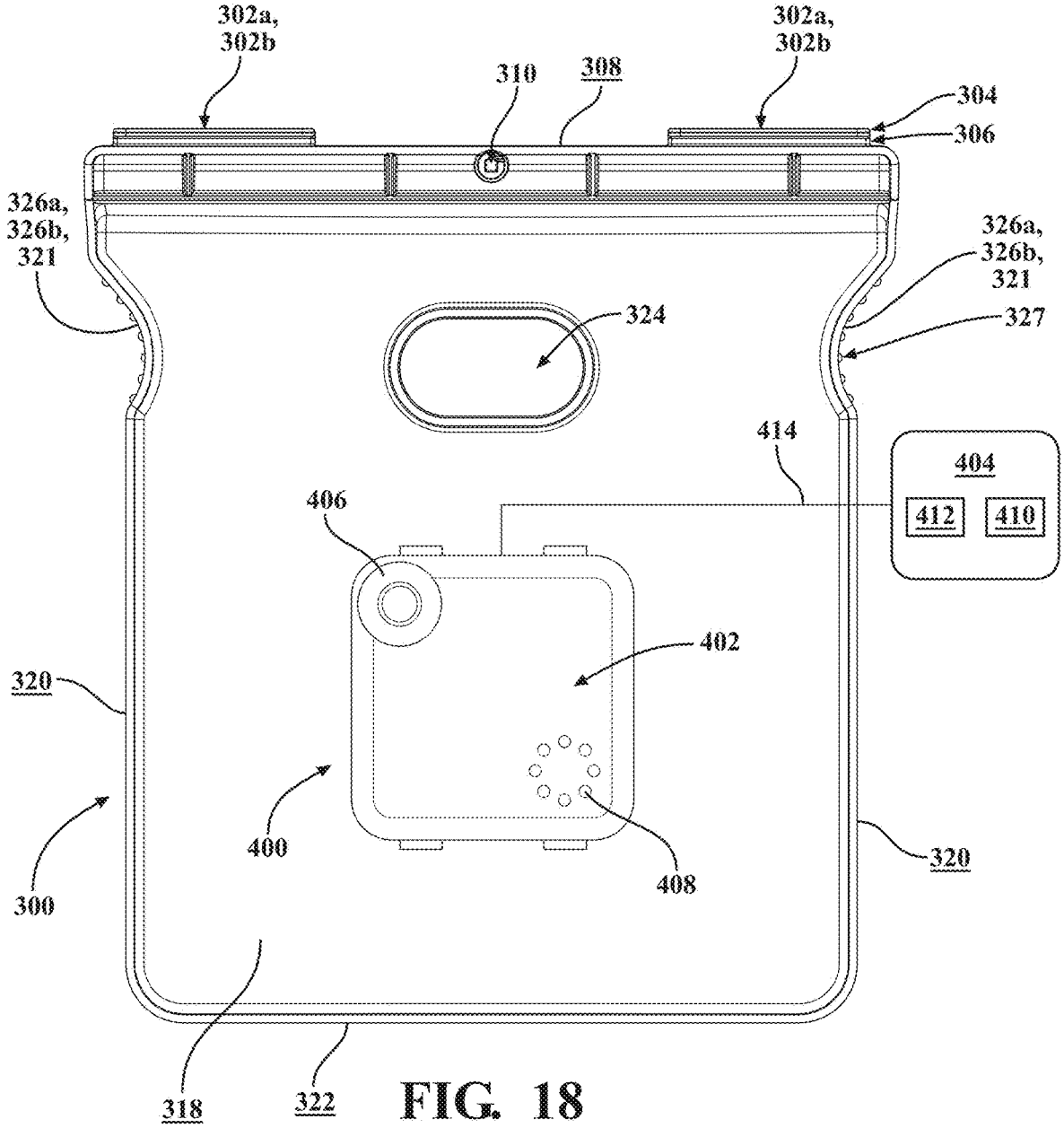

FIG. 17 a side elevation view of the merchandise display unit of FIG. 16, showing the emitter device in communication with controller; and FIG. 18 is a rear elevation view of a tile of the merchandise display unit of FIG. 14 with the emitter device mounted to the rear side of the tile.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Referring to FIGS. 1-13, an example of merchandise display unit 10 including features of the present disclosure is generally shown. The merchandise display unit 10 includes a merchandise security assembly 12 situated between an upper shelf 14 and a lower shelf 26. The merchandise display unit 10 is an example of where the merchandise security assembly 12 could be located within a retail store where customers shop for merchandise. The upper shelf 14 includes a top surface 16 and a bottom surface 18 disposed on an opposite side from the top surface 16. A depth of the upper shelf 14 extends from an upper front edge 20 configured to face a retail space (e.g., a store aisle) to an upper rear edge 22 configured to face a rear wall 42 of the merchandising shelving unit 10. A length of the upper shelf 14 extends between a pair of sides 24 disposed at opposite ends of the upper shelf 14. Similarly, the lower shelf 26 includes a top surface 28 and a bottom surface 30 disposed on an opposite side from the top surface 28. A depth of the lower shelf 26 extends from a lower front edge 32 configured to face the retail space (e.g., the store aisle) to a lower rear edge 34 configured to face the rear wall 42 of the merchandising shelving unit 10. A length of the lower shelf 26 extends between a pair of sides 36 disposed at opposite ends of the lower shelf 26. Optionally, the lower shelf 26 may include a lower shelf lip 38 extending from the top surface 28 at the lower front edge 32 of the lower shelf 26. In use, the lower shelf lip 38 functions as a front stop or retainer for maintaining products 46 on the lower shelf 26. While the merchandise display unit 10 is shown with an upper shelf 14 and a lower shelf 26, it should be appreciated that any number of the shelves 14, 26 may be incorporated into the merchandise display unit 10 product pusher 104.

In the illustrated example, the merchandise display unit 10 may include a pair of vertical posts 40 for supporting each of the upper shelf 14 and the lower shelf 26. However, the shelves 14, 26 may be implemented in other environments, such as directly on a building structure. The merchandise display unit 10 may further includes a retaining rear wall 42 extending between the posts 40 and retaining side walls 44 extending between the shelves 14, 26. When the retaining rear wall 42 is included, the upper rear edge 22 of the upper shelf 14 and the lower rear edge 34 of the lower shelf 26 are positioned adjacent to the retaining rear wall 42 of the shelving unit 10, whereby a space between the upper rear edge 22 and the lower rear edge 34 is enclosed by the retaining rear wall 42 to prevent product 46 from being pushed from the lower rear edge 34 of the lower shelf 26. Similarly, the retaining sidewalls 44 extend between the upper shelf side 24 and the lower shelf side 36 to enclose or partition a length of the merchandise display unit 10.

The merchandise security assembly 12 includes one or more tiles 300 that are located at the front of the merchandise security assembly 12, closest to the customer. Each tile 300 is in front of a row of one or multiple products 46 between the upper shelf 14 and the lower shelf 26. The upper shelf mounting holes 50 are in place to allow the merchandise security assembly 12 to be suspended from the underside of the upper shelf 18, which will be discussed in greater detail below.

Figure 2:
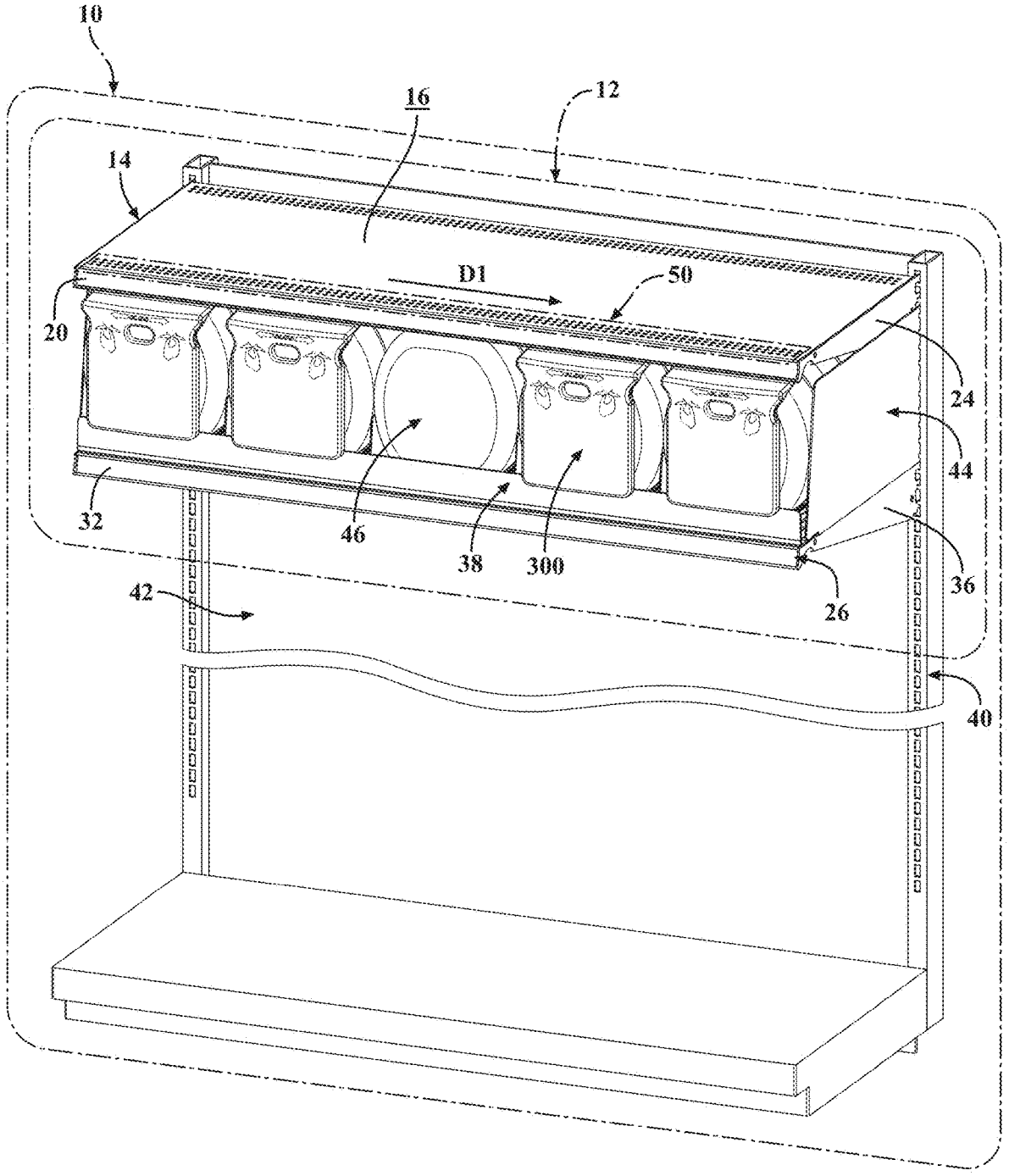
FIG. 2 is a perspective view of the merchandise shelving unit of FIG. 1, with one of the tiles moved to a second position from its first position seen in FIG. 1.

Referring to FIG. 2, the assembly 12 is shown in the merchandise display unit 10, however, one tile 300 has been moved in the direction D1. The ability to slide the tiles 300 is a fundamental feature of the merchandise security assembly 12 that allows customers to access different products 46 located in different product receiving areas. For example, if a customer desires to access a product 46 that is behind a tile 300, the customer will be able to interact with that tile 300 and slide it in the direction D1 to access that row of products 46. This feature allows customers to access whichever product 46 they desire within the merchandise security assembly 12, while keeping the majority of products 46 behind the tiles 300 to deter thieves from shoplifting with the "sweeping" method. The tile rail 200 is able to accommodate one or multiple tiles at a time, depending on the size of the merchandise display unit 10. In order for the tile 300 to have sufficient space to slide along the tile rail 200, there must be at least one product receiving area A that is not obstructed by a tile 300 within a single assembly 12. Facilitating the sliding of the tiles 300 across the front of the merchandise security assembly 12 will be described in greater detail below.

Figure 11:
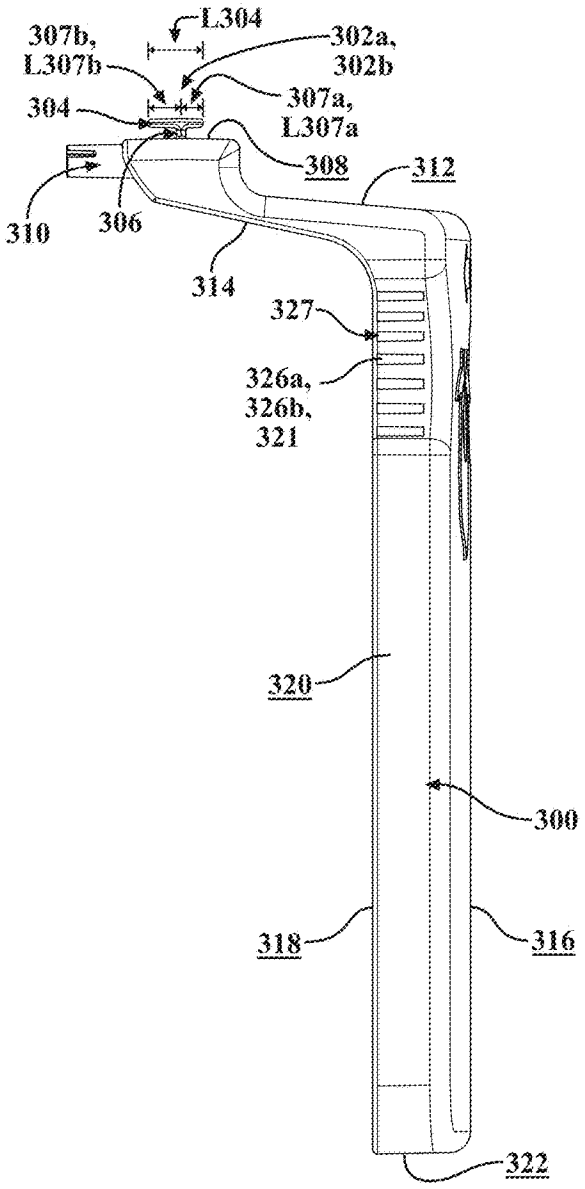
FIG. 11 is a right side elevation view of the tile of FIG. 6.

Referring again to FIGS. 1-13, each tile 300 includes a tile carriage 301 configured to slidably engage the tile rail 200. Particularly, the tile carriage 301 includes a pair of bearing rails 302*a*, 302*b* that attach at a mounting portion 308 of the tile 300 and are slidably received within the bearing track 202. The features of the bearing rails 302*a*, 302*b* are described in greater detail below with respect to FIGS. 4 and 5. The tile carriage 301 is defined by an upper carriage surface 312 and a lower carriage surface 314. As best shown in FIGS. 10 and 11, the tile carriage 301 may form an arm that extends forward from a proximal end at the mounting portion 308 to a distal end spaced apart from the mounting portion 308. The tile further includes a front tile panel 311 extending from the distal end of the tile carriage 301 to a bottom end 322 of the tile 300. Generally, a height of the front tile panel 311 extends along the direction from the distal end of the tile carriage 301 to the bottom end 322 and is transfers to the mounting portion 308. In other words, the front tile panel 311 is configured to be offset from the mounting portion 308 in a forward direction.

Figure 9:
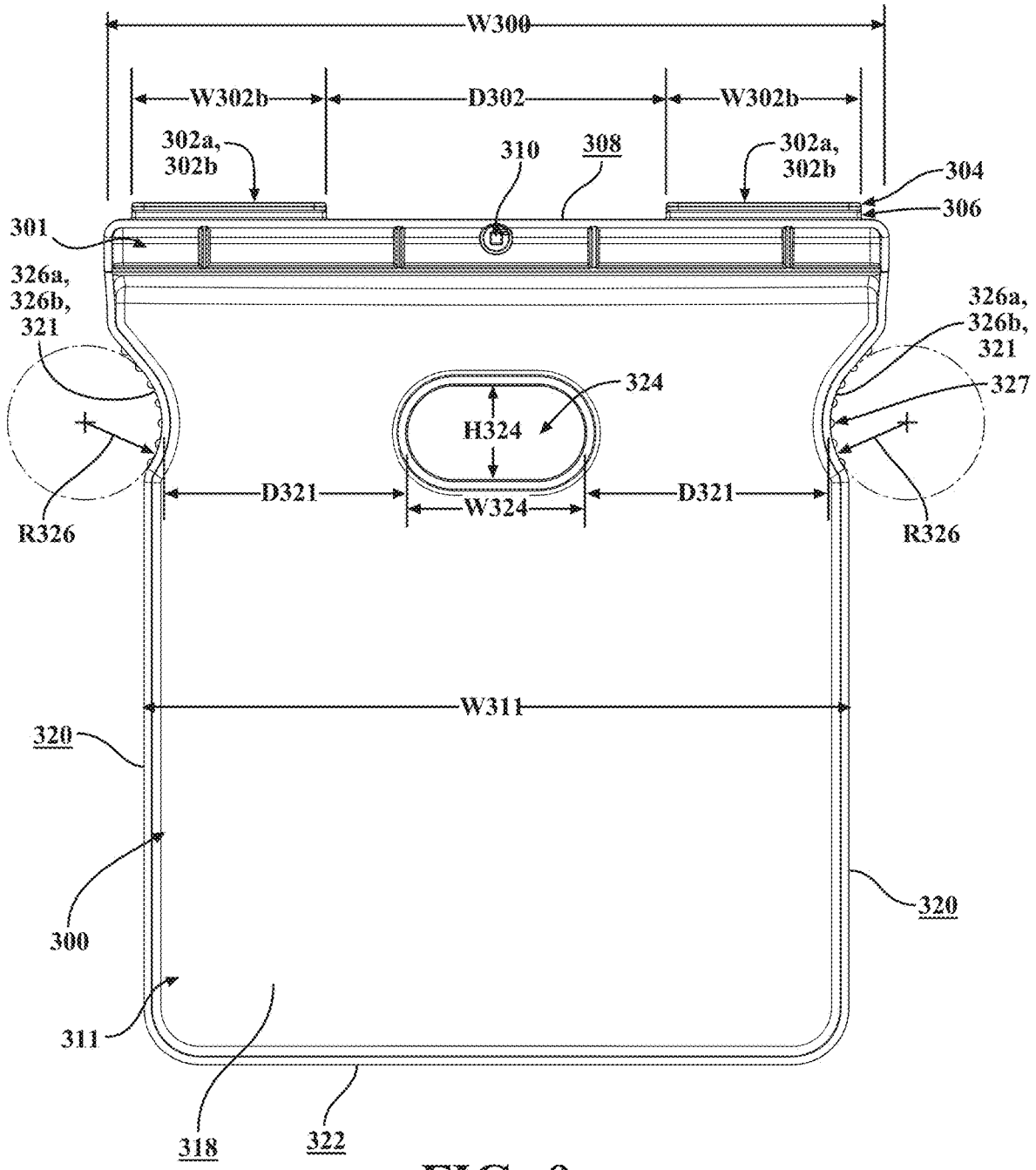
FIG. 9 is a rear elevation view of the tile of FIG. 6.
Figure 10:
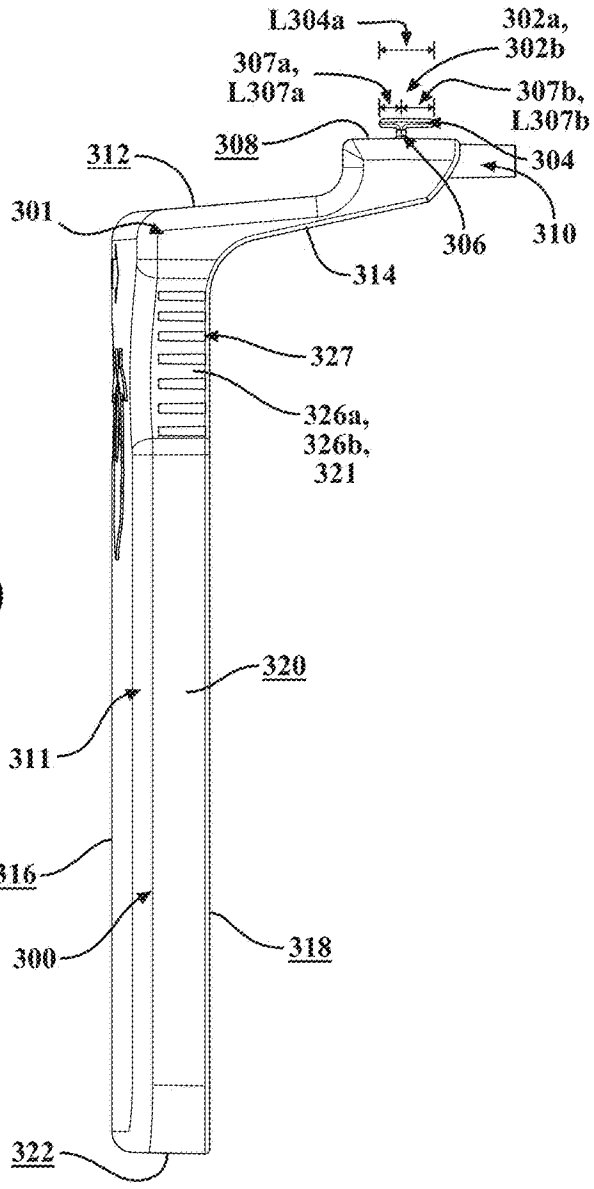
FIG. 10 is a left side elevation view of the tile of FIG. 6.

Referring to FIG. 9, a width $W_{311}$ of the tile panel 311 extends from a first side to an opposite second side 320. The width $W_{311}$ of the tile panel 311 is configured to obstruct a relatively large product receiving area A associated with larger products 46, such as laundry detergents. For example, the width $W_{311}$ of the tile panel 311 may range from 150 mm to 300 mm, and more particularly from 175 mm to 250 mm. In the illustrated example, the width $W_{311}$ of the tile panel 311 is approximately 203 mm (8 inches). Referring still to FIG. 9, the overall width $W_{300}$ of the tile 300 is measured along a width of the carriage 301 and is greater than the width $W_{311}$ of the tile panel 311.

Figure 1:
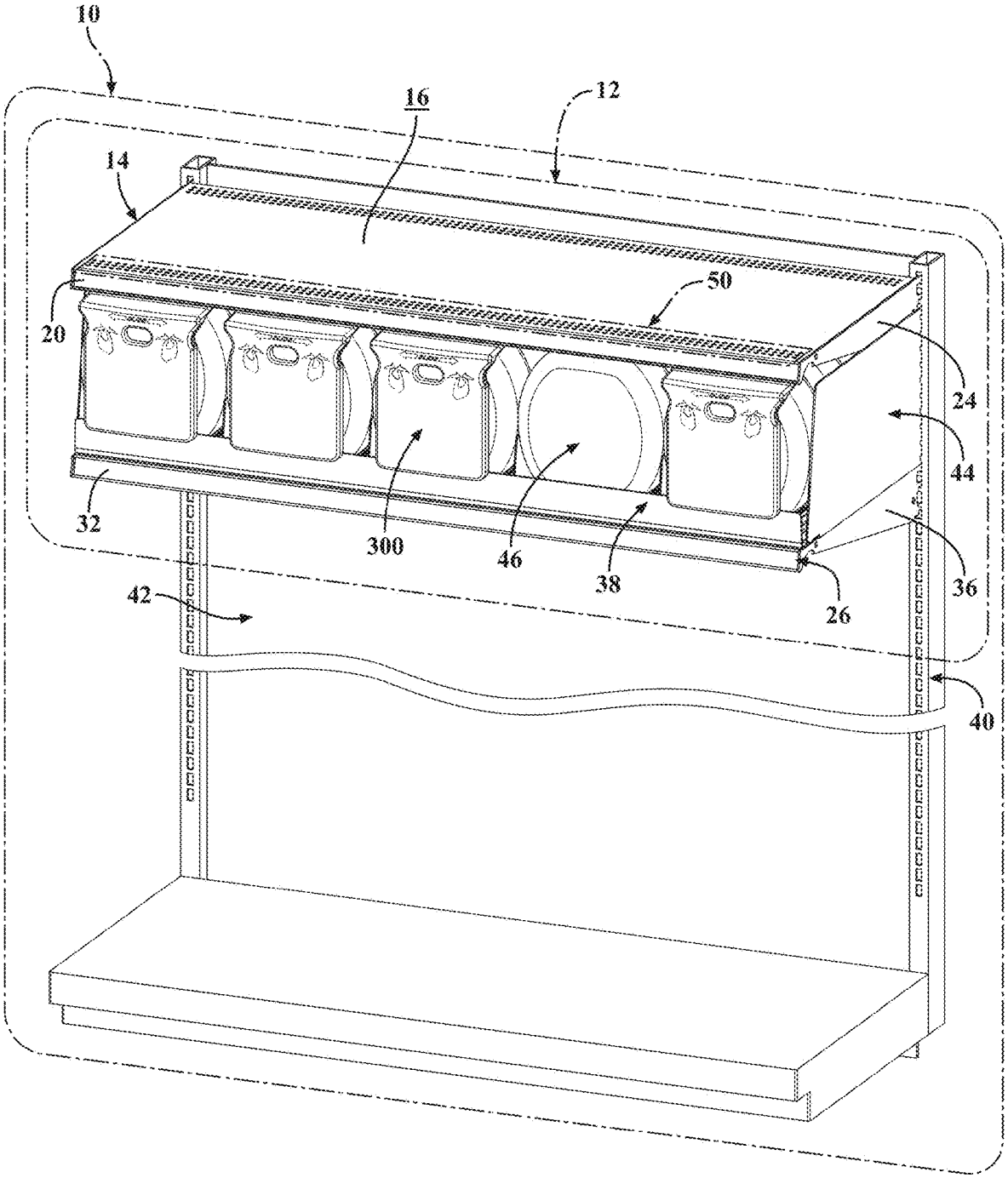
FIG. 1 is a perspective view of an example of a merchandise display unit according to the principles of the present disclosure, where the merchandise display unit includes a plurality of tiles.
Figure 3:
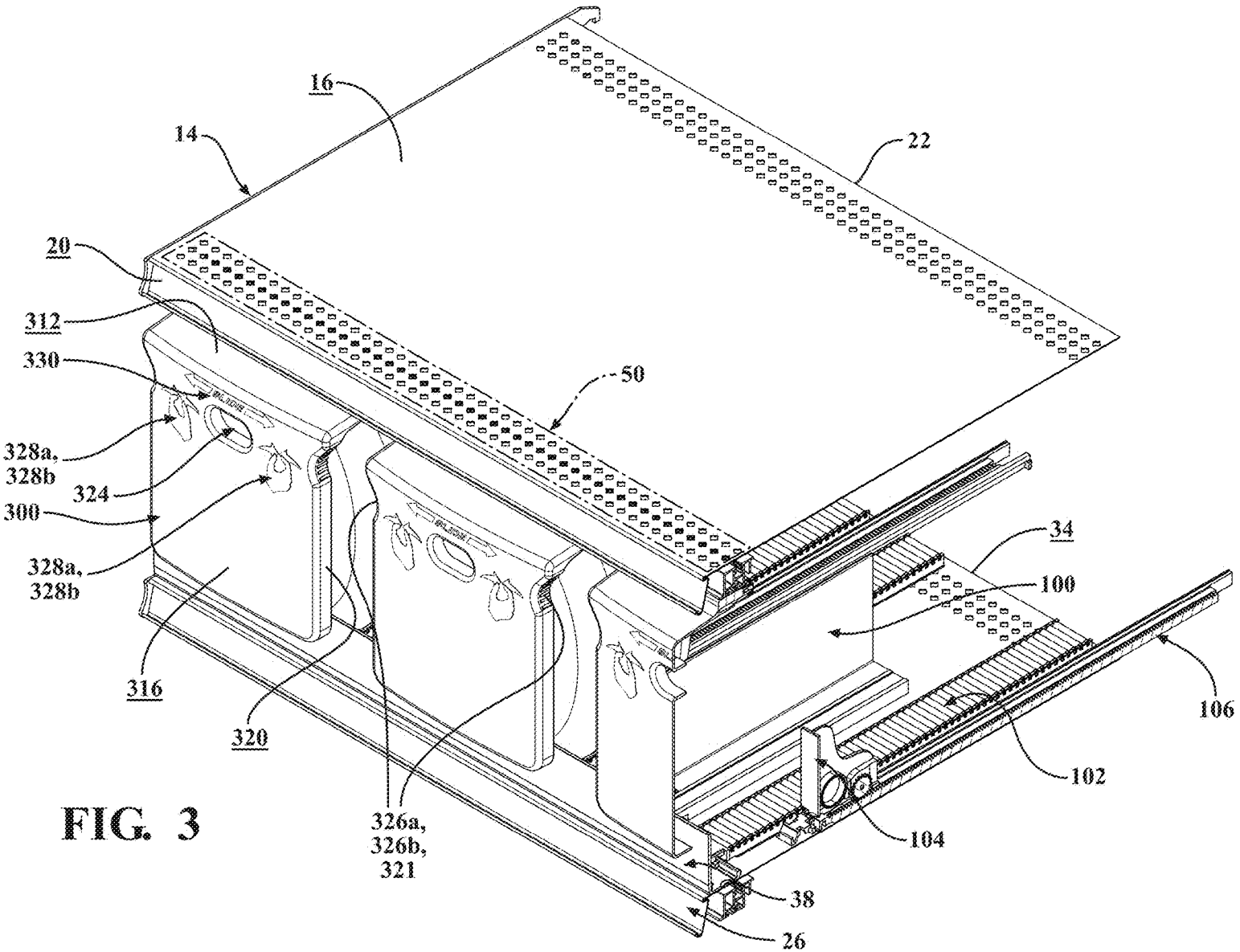
FIG. 3 is a partial perspective view of the merchandise shelving unit, showing a cross section of an individual security assembly taken along Line 3-3 of FIG. 1.

Referring to FIG. 3, a cross section has been taken through the merchandise security assembly 12 along Line 3-3 in FIG. 1. As shown, the cross section is located along a center of a product receiving area A including a single row of products 46. This view provides an illustration of how the products 46 are situated at the front of the merchandise security assembly 12, regardless of how many products 46 are in a single row. The product receiving areas A are separated from each other by a product divider 100, which may be stationary or configured to translate along the length of the merchandise display unit 10 to provide adjustability to widths of the product receiving area A. This product divider 100 keeps the products orderly and in line when multiple product receiving areas A exist within a single assembly 12. Optionally, a pair of roller tracks 102 and a pusher track 106 may be mounted to the top surface 28 of the lower shelf 26 are, per row within the merchandise security assembly 12. In this example, when the products 46 are situated in product receiving area A within the merchandise security assembly 12, the products 46 are supported on the roller tracks 102. In other examples, the products 46 may be supported directly on the lower shelf 26. A product pusher 104 may incorporated on the pusher track 106, and this product pusher 104 forces products 46 to the front of the merchandise security assembly 12. The product pusher 104 biases against the most rearward product 46 present in the product receiving area A. When a customer desires to retrieve a product 46 from the merchandise security assembly 12, the customer will slide a tile 300 along direction D1 to access a specific row of products 46, remove the product 46 from the merchandise security assembly 12, and the product pusher 104 will move along the pusher track 106 to bias the row of products 46 along the roller tracks 102 until the most forward product 46 present in a single row is once against butted against the lower shelf lip 38. This function insures that there is always a product 46 at the front of the merchandise security assembly 12—regardless of whether there is one or multiple products 46 within a single row—as a convenience for the customer.

The sliding of the tiles 300 is performed manually, for example, by a customer or store clerk. The customer would place a thumb in an aperture 324 formed through the front tile panel 311, which is centered between both side surfaces 320 of the tile 300. The aperture 324 extends through a front wall 316 and a rear wall 318 of the tile 300, creating a hole. Horizontally aligned (i.e. along the width $W_{311}$) with the aperture 324 are a pair of finger indentations 328*a*, 328*b*. Each finger indentation 328*a*, 328*b* is positioned along opposing side surfaces 320 of the tile 300. The aperture 324 and the finger indentations 328*a*, 328*b* cooperate to define a pair of grips 321 on opposite sides of the tile panel 311. As shown, the grips 321 are vertically positioned adjacent to the tile carriage 301. Thus, when a biasing force is applied to the grips 321 to translate the tiles 300, a torsional force applied to the tile carriage 301 is minimized to prevent binding of the bearing rails 302*a*, 302*b* in the tile track 202. In this example, "adjacent" refers to the grip 321 being positioned within an upper quartile of the tile panel 311 as between the tile carriage 301 and the bottom end 322.

The customer is able to place a finger in one of the two finger indentations 328*a*, 328*b* while simultaneously placing a thumb in the aperture 324, which allows the customer to grip the tile with a thumb and a finger. Because a finger indentation 328*a*, 328*b* exists on both side surfaces 320 of the tile 300, the customer could use a left hand or a right hand to comfortably grip the tile 300. Additionally, the placement of two finger indentations 328*a*, 328*b* on either side surface 320, combined with the aperture 324 in the center of the tile 300, allow the tile 300 to be oversized to accommodate larger products, for example, jugs of laundry detergent. The average-sized hand of the average adult may not be able to grip both finger indentations 328*a*, 328*b* simultaneously, however, the average-sized hand will be able to grip one of the two finger indentations 328*a*, 328*b* and the aperture 324 simultaneously, allowing the tile to be moved with a single hand. Once the tile 300 is gripped, the customer has the ability to slide the tile 300, side to side, exposing a row of products 46 while hiding another row of products 46 with the newly positioned tile 300.

Figure 5:
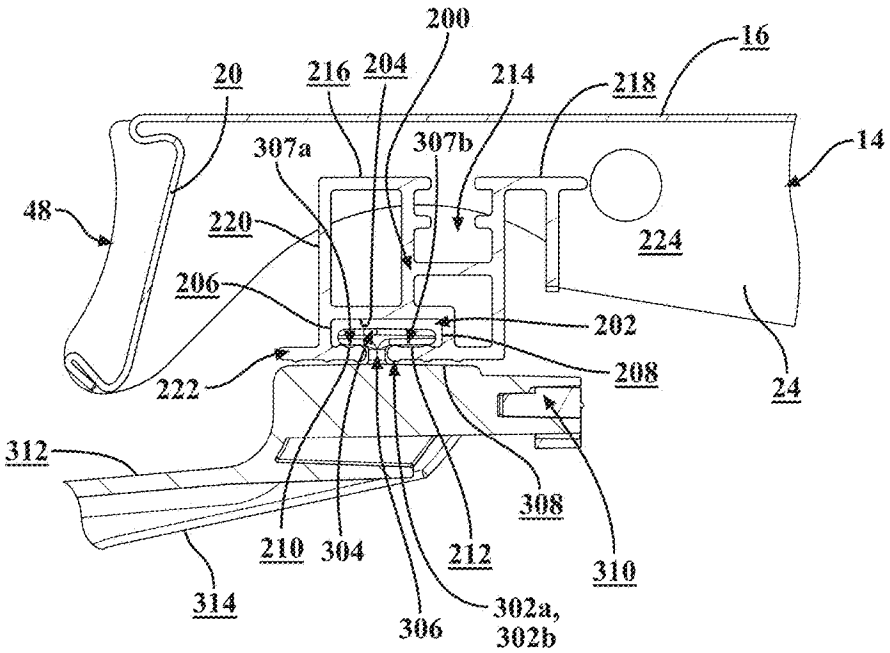
FIG. 5 is a detailed view of the merchandise display unit of FIG. 4, showing the bearing rails engaged with the tile rail.
Figure 4:
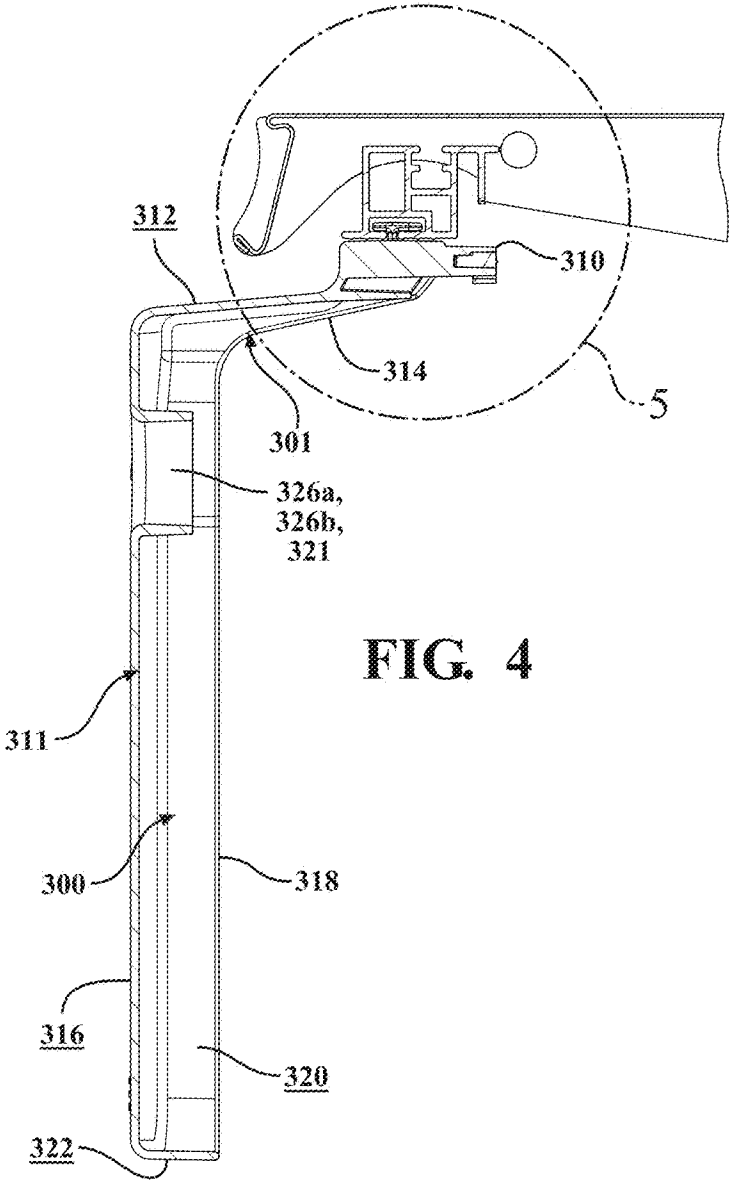
FIG. 4 is a side elevation view of the merchandise display unit of FIG. 3, showing a tile engaged with a tile rail.

Referring to FIG. 4 and FIG. 5, the sliding action of the tile 300 is accommodated by a tile rail 200, which is incorporated in the merchandise security assembly 12. Both FIG. 4 and FIG. 5 offer a side view of the tile rail 200, the tile 300, and a portion of the upper shelf 14. FIG. 5 offers a more detailed view of the tile rail 200 interacting with the upper shelf 14 and the tile 300. The tile 300 includes a pair of bearing rails 302*a*, 302*b*. When fully assembled, the bearing rails 302*a*, 302*b* are situated in a tile track 202 of the tile rail 200. Each of the bearing rails 302*a*, 302*b* include a flange 304 and a neck 306. The neck 306 provides a gap between a mounting surface 308 of the tile 300 and the flange 304, allowing the flange 304 to be the only component of the tile 300 supported within the tile track 202. Additionally, the neck 306 and the flange 304 work to suspend the tile 300 from the tile rail 200 when the flange 304 is received within the tile track 202. When the tile 300 is suspended from the tile rail 200, the neck 306 prevents the mounting surface 308 from interfering with (i.e., rubbing against) the tile rail 200, as the neck 306 provides a gap between the mounting surface 308 and the flange 304. Because of this, the mounting surface 308 is spaced below the lower front lip 222 of the tile rail 200.

The flange 304 of each bearing rail 302*a*, 302*b* rests upon the interior forward bottom surface 210 and the interior rearward bottom surface 212 of the tile track 202. Due to the bulbous design of the flange 304, the flange 304 is able to slide within the tile track 202 with a reduced amount of friction, minimizing the amount of force required from the customer to slide the tile 300. The flange 304 incorporates a front flange portion 307*a* and a rear flange portion 307*b*. With reference to FIG. 10 and FIG. 11, the rear flange portion 307*b* has a length $L_{307b}$, which is situated above the interior rearward bottom surface 212 of the tile track 202. The front flange portion 307*a* has a length $L_{307a}$, which is situated above the interior forward bottom surface 212 of the tile track. The length $L_{307b}$ of the rear flange portion 307*b* is designed to be greater than the length $L_{307a}$ of the front flange portion 307*a*, which is done to match the design of the tile track 202. Combining the length $L_{307b}$ of the rear flange portion 307*b* with the length $L_{307a}$ of the front flange portion 307*a* results in the overall length $L_{304}$ of the flange 304. This length $L_{304}$ of the flange 304 can be no greater than the space allotted in the tile track 202. The flange 304 must be able to sit inside the tile track 202 without touching the interior front wall 206 of the tile track 202 while also not touching the interior rear wall 208 of the tile track 202, otherwise, it would increase the amount of friction during the sliding process of the tile 300. Additionally, while the front flange portion 307*a* sits on the interior forward bottom surface 210 and the rear flange portion 307*b* sits on the interior rearward bottom surface 212 of the tile track 202, the flange 304 must not be in contact with the interior underside top surface 204 of the tile track 202. This space between the flange 304 and the interior underside top surface 204 is necessary to also prevent increased friction during the sliding process of the tile 300. The interior underside top surface 204, the interior front wall 206, and the interior real wall 208, help to maintain the correct position and orientation of the flange 304 within the tile track 202.

The tile rail 200 includes a mounting cavity 214. This mounting cavity 214 is designed to accept a mounting device, for example, a bolt or a screw, that fits inside the mounting cavity 214 and through an upper shelf mounting hole 50. The mounting cavity 214 sits between the forward top surface 216 and rearward top surface 218 of the tile rail 200. When mounted, the tile rail 200 is suspended and the forward top surface 216 and rearward top surface 218 are butted against the underside 30 of the upper shelf 14. Fixing the tile rail 200 to the underside 30 of the upper shelf 14 allows the tile 300 to be suspended from the tile rail 200 when the flange 304 is inserted within the tile track 202.

The rear wall 224 of the tile rail 200 provides additional structure to the tile rail 200 and also helps to accommodate the rearward top surface 218, providing stability to the tile rail when mounted to the underside 30 of the upper shelf 14. Additionally, the lower front lip 222 of the tile rail 200 helps to maintain the position of the tile 300. While the neck 306 provides a space between the flange 304 and the mounting surface 308 of the tile, which provides a clearance between the lower front lip 222 and the mounting surface 308, the clearance is large enough to prevent unnecessary increased friction during the sliding process of the tile 300, but small enough to keep the tile positioned correctly below the tile rail 200 and prevent unnecessary forward and backward rotation of the tile 300.

Figure 6:
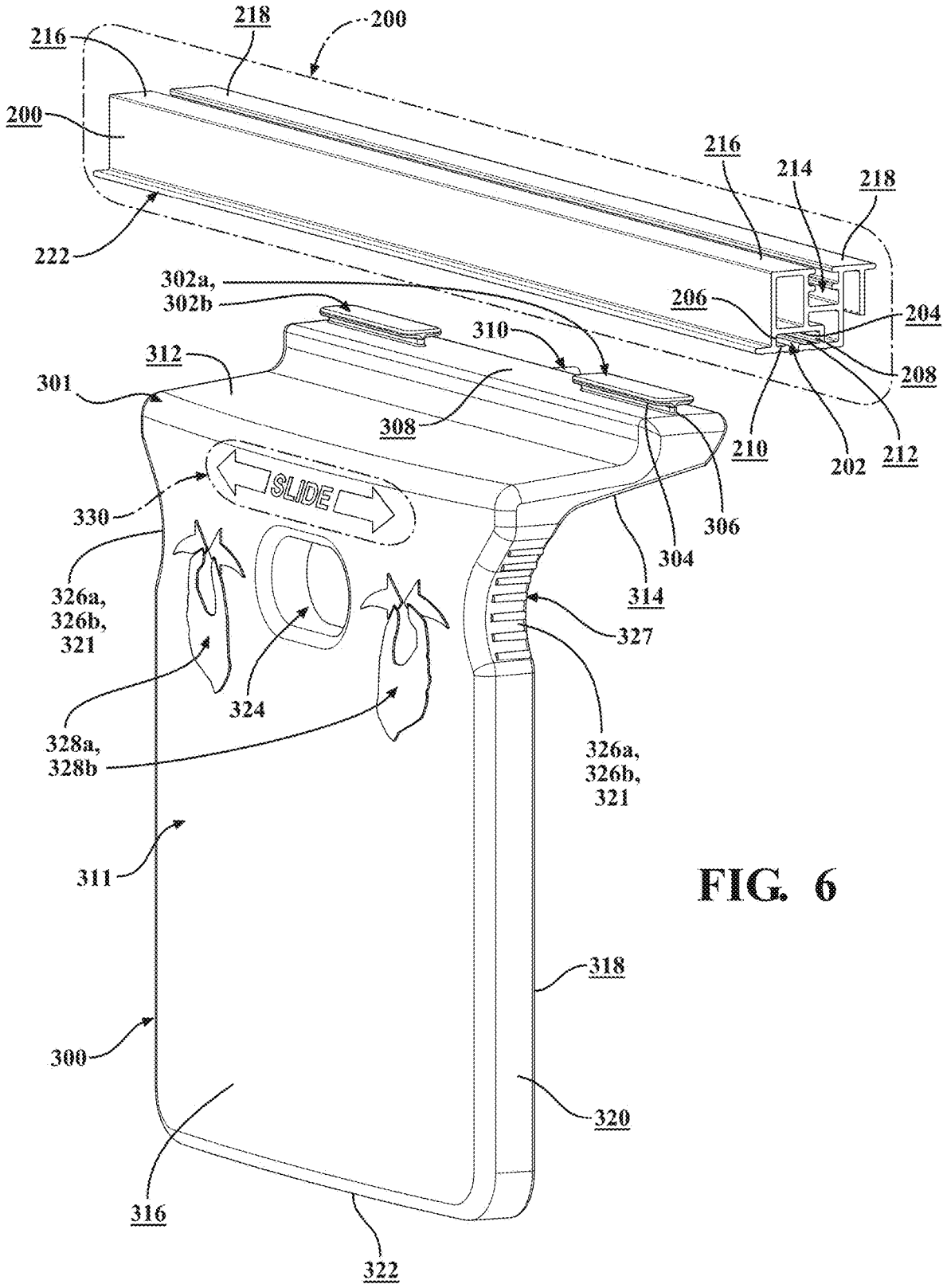
FIG. 6 is an exploded view of the tile and the tile rail.

Referring to FIG. 6, the pair of bearing rails 302*a*, 302*b* are positioned along a mounting surface 308 of the tile 300. By incorporating a pair of bearing rails 302, 302*b*, the tile 300 is configured to accommodate irregularities in the tile trail 200. Particularly, a tile 300 having a relatively large width $W_{300}$ extends along a greater length of the tile rail 200 than a tile having a relatively narrow width $W_{300}$. As the width $W_{300}$ of the tile 300 increases, slight variations in the straightness of the tile rail 200 and tile track 202, which are common due to manufacturing tolerances associated with molding and extrusion processes, are more likely to cause interference or binding in configurations of tiles including a single bearing rail. Thus, by providing a pair of the bearing rails 302*a*, 302*b* spaced along the width $W_{300}$ of the tile 300, the manufacturing variations in the tile track 202 are more easily accommodated by the shorter widths $W_{302a}$, $W_{302b}$ of the bearing rails 302*a*, 302*b* as the tile 300 translates along the tile track 202. In other words, the shorter widths $W_{302a}$, $W_{302b}$ and the spacing $D_{302}$ of the bearing rails 302*a*, 302*b* allow the sides of the tile 300 associated with each bearing rail 302*a*, 302*b* to independently articulate along the tile track 202 as the tile 300 is moved in the direction D1.

Figure 7:
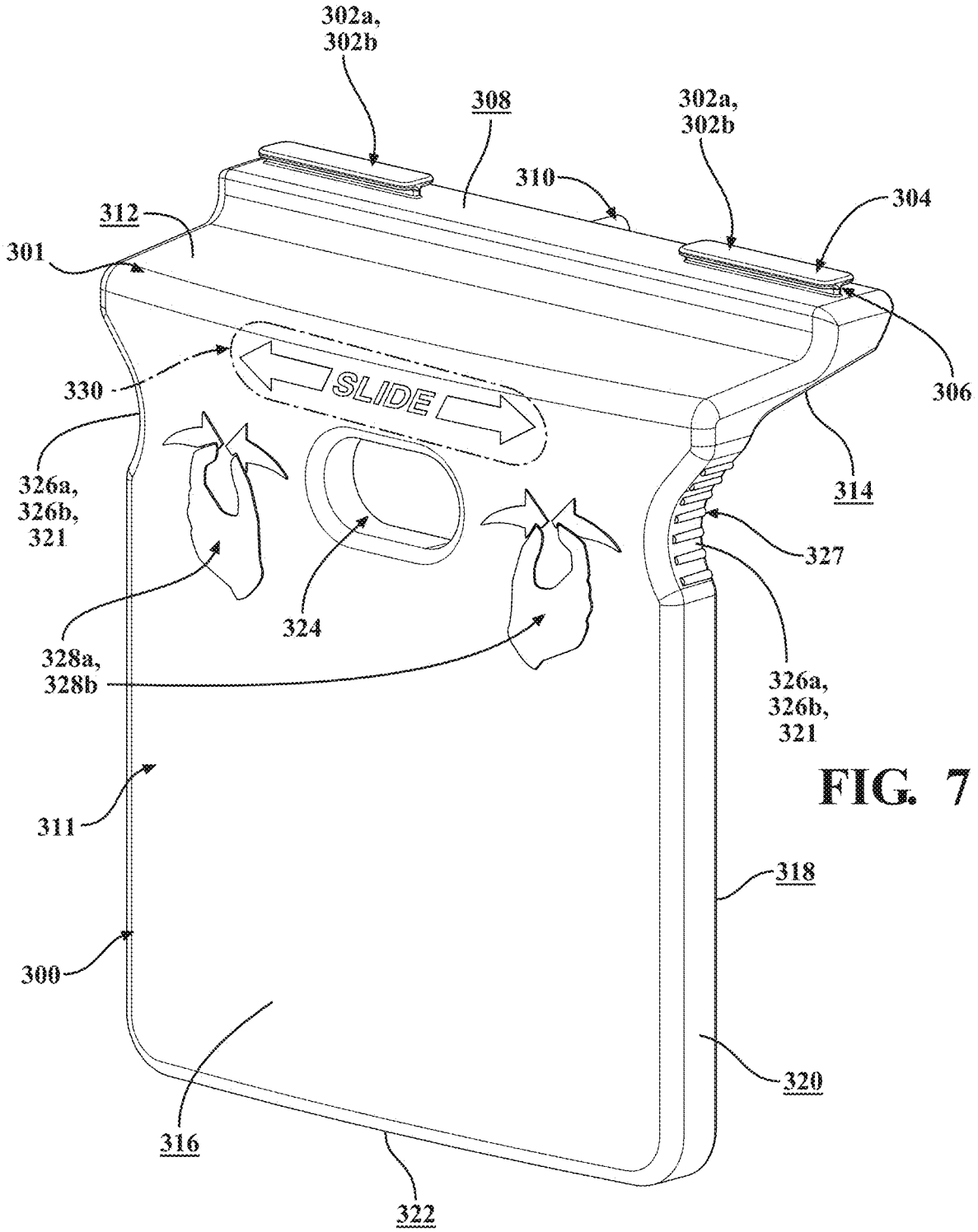
FIG. 7 is a perspective view of the tile of FIG. 6.

Referring to FIG. 7, the front wall 316 of the tile 300 incorporates a pair of operation displays 328*a*, 328*b* that provide instructions to the customer regarding how to grip the tile 300. Both a left hand and a right hand are shown in the operation displays 328*a*, 328*b*, along with the gripping procedure between a thumb and an index figure to be placed in the aperture 324 and either finger indentation 326*a*, 326*b*, respectfully. The movement display 330 indicates to the customer that the tile 300 is intended to translate along the tile rail 200 in the direction D1. Grips 321 may be incorporated within the finger indentations 326*a*, 326*b*. While the grips 321 may be integrally molded with the tile 300, in some examples these grips 321 include a material that increases friction between the finger indentations 326*a*, 326 and a finger, providing a comfortable and secure surface for the finger to grip the tile 300. Additionally, the grips 321 incorporate a series of finger indentation ribs 327, which even further secure a finger against the finger indentations 326*a* 326*b*.

As provided previously, the tile carriage 301 includes the upper carriage surface 312 and the opposite bottom carriage surface 314, which cooperate to extend the front wall 316 of the tile 300 to the front of the merchandise security assembly 12, while positioning the mounting surface 308 and bearing rails 302*a*, 302*b* further rearward in the merchandise security assembly 12. This allows for the tile rail 200 to be mounted on the underside 18 of the upper shelf 14, with the bearing rails 302*a*, 302*b* installed in the tile track 202, while keeping the front wall 316 of the tile 300 in front of the upper front edge 20 of the upper shelf 14 and in front of the lower front edge 32 of the lower shelf 26. Also, the bottom 322 of the tile 300 and rear wall 318 of the tile 300 are positioned in front of the lower shelf lip 38. Accordingly, the tile 300 is spaced forward of a front surface of the product 46, allowing the customer access to grip the tile 300, all while the bearing rails 302*a*, 302*b* are installed in the tile track 202.

Figure 8:
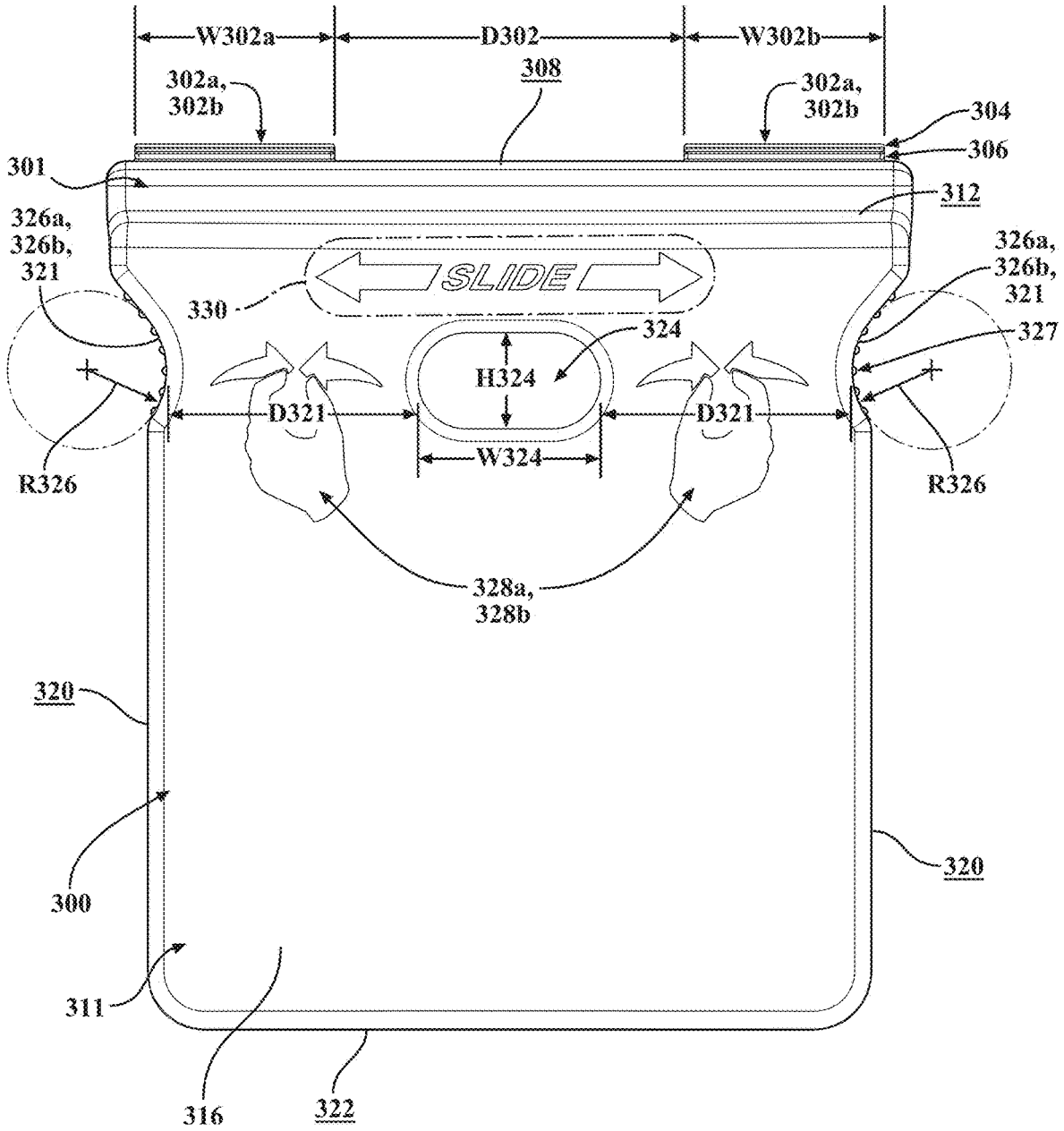
FIG. 8 is a front elevation view of the tile of FIG. 6.

Referring to FIG. 8 and FIG. 9, the widths $W_{302a}$, $W_{302b}$ of the bearing rails 302*a*, 302*b* are of an equal dimension, wide enough to support the sliding motion and weight of the tile 300, while narrow enough to prevent excess torsional rotation and friction during the sliding process. The bearing rails 302*a*, 302*b* are separated by a bearing rail spacing distance $D_{302}$. The location and sizing of certain tile 300 features are implemented to provide comfortable ergonomics for the customer interacting with the tile 300. The aperture 324 has a height $H_{324}$ and a width $W_{324}$. Both the height $H_{324}$ and width $W_{324}$ are sized no smaller than the size required to accept the thumb of the average adult. For example, the apertures 324 may have a width $W_{324}$ of at least 25 mm and a height $H_{324}$ of at least 25 mm. In the illustrated example, the aperture 324 is provided as an obround aperture having an overall width $W_{324}$ corresponding to the width $W_{311}$ of the tile panel 311 to maintain a constant grip width $D_{321}$. The grip width $D_{321}$ is the distance between the edge of the aperture 324 and the nearest finger indentation 326*a*, 326*b*. This grip width $D_{321}$ is designed to be no larger than the distance the average adult can comfortably grip an object between a thumb and an index finger. For example, when the tile panel 311 has a width of 200 mm (8"), the width $W_{324}$ of the aperture 324 may be 50 mm to maintain a grip width $D_{321}$ that can be easily grasped by a user. For example, a grip width ranging from 62 mm to 75 mm is desirable. Thus, for wider tile panels 311, the aperture width $W_{324}$ would be increased proportionally. Additionally, the finger indentations 326*a*, 326*b* are rounded to comfortably fit the finger of a customer. The finger indentation curvature radius $R_{326}$ is determined based on the size of the average adult finger.

Figure 12:
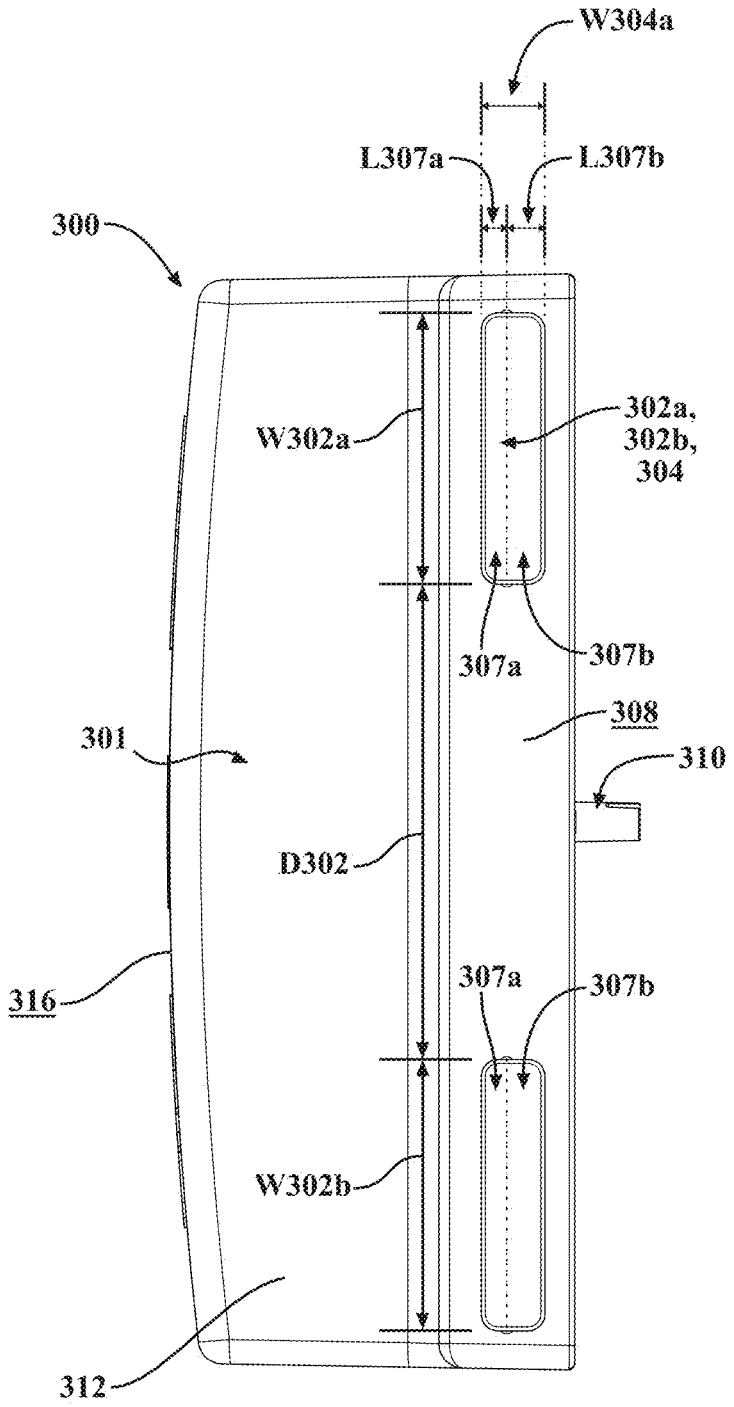
FIG. 12 is a top plan view of the tile of FIG. 6.
Figure 13:
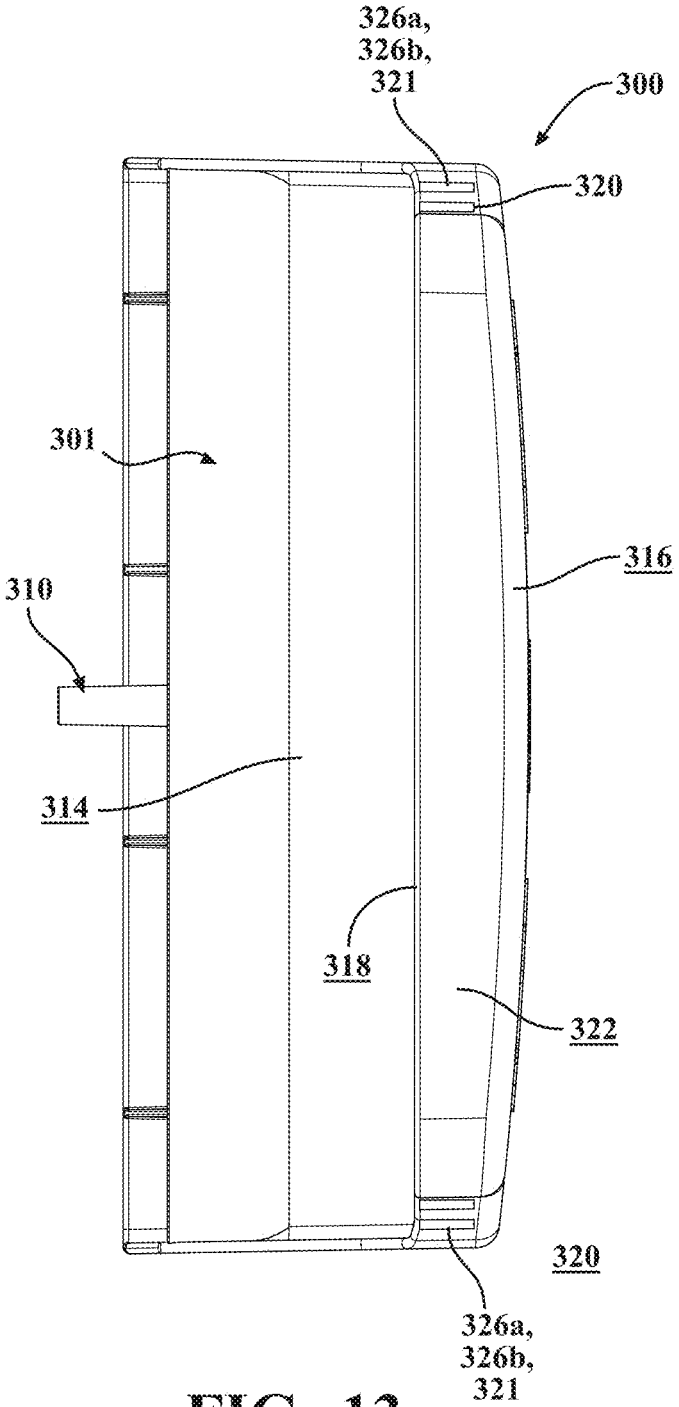
FIG. 13 is a bottom plan view of the tile of FIG. 6.

Referring to FIG. 12 and FIG. 13, an optional mounting tab 310 extends beyond the mounting surface 308, and is present in the center of the distance D302 between the bearing rails 302*a* 302*b*. When included, the mounting tab 310 may be configured to engage an audible feedback device associated with the tile rail 200. For example, the mounting tab 310 may include a flag or finger that extends upward and selectively engages a series of teeth or detents formed along a bottom side of the tile rail 200, whereby the mounting tab 310 provides resistance and/or generates an audible feedback as the tile 300 is translated in the direction D1 along the tile rail 200.

With particular reference to FIGS. 14-18, another example of the merchandise display system 10 is provided and includes. Optionally, the merchandise security assembly 12 can, for example, include a motion notification system 400 that is configured to generate an audible signal whenever the tile 300 is translated in the direction D1. As discussed above, the motion notification system 400 may be a mechanical system including the mounting tab 310 engaging a corresponding rail to generate audible feedback as the tile 300 translates. In the illustrated example, the motion notification system includes an emitter device 402 configured to generate an electronic motion notification, such as an audible sound from a speaker 408, when a tile 300 is moved. Referring to FIGS. 14-18, the emitter device 402 is attached to the rear wall 318 of a tile 300.

The emitter device 402 includes a computing system 404, an emitter device sensor 406, and an emitter device speaker 408. While the tile 300 translates along the tile rail 200, the emitter device sensor 406 gathers motion sensor data. When a tile 300 is translated in a direction D1, the movement is detected by an emitter device sensor 406. For example, the emitter device sensor 406 may include a motion sensor 406, such as an inertia sensor or an ultrasonic sensor that detects movement of the emitter device 402 and generates a motion signal. As the emitter device sensor 406 gathers the motion sensor data, the computing system 404 is configured to store, process, and/or communicate the sensor data within the retail environment. In order to perform computing tasks related to the sensor data, the computing system 404 of the emitter device 402 includes data memory hardware 410 and data processing hardware 412. The data processing hardware 414 is configured to execute instructions stored in the memory hardware 410 to perform computing tasks related to operation and management of emitter device 402. Generally speaking, the computing system 404 refers to one or more locations of data processing hardware 412 and/or memory hardware 410.

In some examples, the computing system 404 is a local system located on the emitter device 402. When located on the emitter device 402, the computing system 404 may be centralized (i.e., in a single location/area on the emitter device, for example, a vehicle control unit), decentralized (i.e., located at various locations about emitter device 402), or a hybrid combination of both (e.g., where a majority of centralized hardware and a minority of decentralized hardware). To illustrate some differences, a decentralized computing system 404 may allow processing to occur at an activity location (e.g., at emitter device sensor 406) while a centralized computing system 404 may allow for a central processing hub that communicates to systems located at various positions on the emitter device (e.g., communicate to the speaker 408).

Additionally or alternatively, the computing system 404 includes computing resources that are located remotely from the emitter device 402. For instance, the computing system 404 may communicate via a network 414 with a remote computing system 404 (e.g., a remote computer/server or a cloud-based environment). Here, sensor data or other processed data (e.g., data processing locally by the computing system 404) may be stored in the remote computing system 404 and may be accessible to the local computing system 404.

In some examples, the emitter device 402 is configured to operate as a standalone unit including the local computing system 404. In such examples, the emitter device 402 may not communicate externally. In other word, the sensor data generated by the emitter device sensor(s) 406 is processed at the computing system 404 on the emitter device 402. When the local computing system 404 receives the sensor data, the computing system 404 evaluates the sensor data to determine whether a measured motion exceeds a motion threshold. When the computing system 404 determines that the measured motion exceeds the motion threshold, the computing system 404 sends a notification signal to the notification device 408 (e.g., a speaker) to generate a notification output 416. For example, the speaker 408 may output a chirp or alarm sound then the measured motion exceeds the motion threshold. Alerting the movement of a tile 300 through notification signal provides the facilitator of the merchandise security assembly 12 with an indication that someone may be interacting with the merchandise security assembly 12, allowing the facilitator to take an appropriate action based on the specific circumstance.

In examples where the emitter device 402 is incorporated within a security ecosystem, a connection between the emitter device 402 and a remote computing device 404 may be facilitated by a network 414 (e.g., a local network or cloud-based network), which allow a user to monitor and configure the motion notification system 400 based on individual preferences.

The addition of a motion notification system 400 to the rear wall 318 of the tile 300 will position the emitter device 402 in a manner that will not interfere with the general physical operation of the merchandise security assembly 12. Because the rear wall 318 of the tile 300 is positioned in front of the lower shelf lip 38, and the products 46 are positioned behind the lower shelf lip 38, a gap exists between the tile 300 and the products 46. Therefore, sufficient space exists for the placement of an emitter device 402 on the rear wall 318 of the tile 300 without physically contacting the row of products 46 positioned on the lower shelf 26.

The terminology used herein is for the purpose of describing particular example configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed herein could be termed a second element, component, region, layer or section without departing from the teachings of the example configurations.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A merchandise display system comprising:

a tile rail defining a tile track extending along a first direction; and a plurality of tiles slidably engaged with the tile rail and configured to independently translate along the first direction, each tile including a tile carriage slidably engaged with the tile rail and a front tile panel extending transverse to the tile carriage, the front tile panel including an aperture formed therethrough and having a height extending in a second direction from the carriage to a distal end and a width extending from first side surface defining a first indentation to an opposite second side surface defining a second indentation, each of the first indentation, the second indentation, and the aperture confined in a quartile of the front tile panel closest to the carriage.

2. The system of claim 1, wherein each tile of the plurality of tiles includes a pair of T-shaped bearing rails engaged with the tile track.

3. The system of claim 2, wherein each of the bearing rails defines a width ranging from 10 mm to 75 mm.

4. The system of claim 1, wherein the first indentation and the second indentation are aligned with the aperture along the width of the front tile panel.

5. The system of claim 4, wherein a distance from the aperture to either of the first indentation or the second indentation ranges from 50 mm to 100 mm.

6. The system of claim 4, wherein the each of the first indentation and the second indentation includes a plurality of ribs.

7. The system of claim 1, further comprising an audible feedback system configured to generate an audible feedback output when the tile is translated along the rail.

8. The system of claim 7, wherein the audible feedback system includes an audible feedback emitter attached to the tile, the audible feedback emitter including an emitter device sensor configured to generate motion sensor data when the tile is translated and a speaker configured to generate the audible feedback output when the motion sensor data is generated.

9. A merchandise display system comprising:

a tile rail defining a tile track extending along a first direction; and a tile including:

a tile carriage having a plurality of T-shaped bearing rails engaged with the tile rail; and a front tile panel having a height extending from the tile carriage to a distal end and including (i) an aperture formed therethrough, (ii) a first indentation formed along a first side surface, and (iii) a second indentation formed along an opposite second side surface, each of the aperture the first indentation, and the second indentation die posed-confined in a quartile of the front tile panel closest to the carriage.

10. The merchandising system of claim 9, wherein the aperture is aligned with the first indentation and the second indentation.

* * * * *